US011109658B1

(12) United States Patent
Khodzhayan

(10) Patent No.: US 11,109,658 B1
(45) Date of Patent: Sep. 7, 2021

(54) COSMETIC APPLICATOR

(71) Applicant: Stephanie Khodzhayan, Brooklyn, NY (US)

(72) Inventor: Stephanie Khodzhayan, Brooklyn, NY (US)

( * ) Notice: Subject to any disclaimer, the term of this patent is extended or adjusted under 35 U.S.C. 154(b) by 0 days.

(21) Appl. No.: 16/815,060

(22) Filed: Mar. 11, 2020

(51) Int. Cl.

| | |
|---|---|
| ***A47L 11/08*** | (2006.01) |
| ***A45D 34/04*** | (2006.01) |
| ***A45D 40/26*** | (2006.01) |
| ***A45D 34/06*** | (2006.01) |
| ***A45D 40/24*** | (2006.01) |

(52) U.S. Cl.
CPC ..... *A45D 34/041* (2013.01); *A45D 34/06* (2013.01); *A45D 40/24* (2013.01); *A45D 40/261* (2013.01)

(58) Field of Classification Search
CPC .... A45D 34/041; A45D 34/06; A45D 40/261; A45D 40/24
USPC ..... 401/18, 21
See application file for complete search history.

(56) References Cited

U.S. PATENT DOCUMENTS

| | | | | |
|---|---|---|---|---|
| 6,035,865 | A * | 3/2000 | Krieger | A45D 34/06 132/293 |
| 6,276,853 | B1 * | 8/2001 | Breidenbach | A45D 34/06 401/17 |
| 6,568,529 | B2 * | 5/2003 | McMurrey | A45D 40/24 132/317 |
| 10,004,318 | B1 | 6/2018 | Levneff et al. | |
| 10,051,942 | B2 | 8/2018 | Golding | |
| 10,206,479 | B2 | 2/2019 | Gieux et al. | |
| 2004/0258452 | A1 * | 12/2004 | Shyu | B43K 19/02 401/57 |
| 2008/0003052 | A1 | 3/2008 | Lee et al. | |
| 2008/0145133 | A1 * | 6/2008 | Palmer | B65D 21/0231 401/18 |
| 2012/0318707 | A1 | 12/2012 | Zivitz et al. | |
| 2018/0199690 | A1 | 7/2018 | Steele | |

OTHER PUBLICATIONS

Gotoilsupplies.com. Dual Fitment 10ML Roller Bottle. https://www.gotoilsupplies.com/dual-fitment-10ml-roller-bottle-frosted-purple-for-essential-oils/?gclid=EAIalQobChMljfypjoWZ6gIV0MDACh0cLwe6EAQYAiABEgICK_D_BwE [date accessed: Jun. 28, 2020].

(Continued)

*Primary Examiner* — Jennifer C Chiang
(74) *Attorney, Agent, or Firm* — Michael J. Feigin, Esq.; Feigin and Fridman LLC

(57) ABSTRACT

A cosmetic applicator includes a bottle and one or more sections that are removably attachable to one another in a stacked configuration. The bottle includes a reservoir, a first roller ball housing, a first fastener, and a first recess including a second fastener. Each section includes a receptacle, a second roller ball housing, a third fastener, and a second recess including a fourth fastener. The first recess removably receives the second roller ball housing. The second recess of a first section removably receives the second roller ball housing of a second section. The third fastener of a first section engages the second fastener of the bottle and the fourth fastener of a second section to allow connection of a section to the bottle and connection of the sections to each other, thereby enabling attachment of the bottle and the sections to one another in an interchangeably stacked configuration.

20 Claims, 6 Drawing Sheets

(56) References Cited

OTHER PUBLICATIONS

Beautypackaging.com. "Silos Expands Patent-Pending Dual-Neck Vial Offerings." https://www.beautypackaging.com/contents/view_breaking-news/2019-12-10/siloa-expands-patent-pending-dual-neck-vial-offerings/ [date accessed: Jun. 28, 2020].
www.raymondgeddes.com, Rainbow Stacks Highlighter, https://www.raymondgeddes.com/66574-rainbow-stacks-highlighter [date accessed: Oct. 31, 2019].

* cited by examiner

COSMETIC APPLICATOR

FIELD OF THE DISCLOSED TECHNOLOGY

The disclosed technology relates to cosmetic applicators. More specifically, the disclosed technology relates to a cosmetic applicator including removably attachable cosmetic applicator sections that attach to each other in a stacked configuration and include roller ball applicators.

BACKGROUND OF THE DISCLOSED TECHNOLOGY

Conventional roller ball applicators provide simply one roller ball and one container or body for storing a sole material to be applied. For example, U.S. Pat. No. 10,206,479 to Gieux et al. discloses an applicator for the application of a liquid including a single body and a roller ball held by a magnet. U.S. Patent Application Publication No. 2008/0003052 to Lee et al. discloses a roller ball delivery device for delivering liquid to a surface including a single body for holding the liquid.

While these references disclose roller ball applicators for the delivery of materials to a surface, improvements are needed which enable multifaceted use by providing a variety of materials that can be applied by different roller balls, and which allow more efficient application and sharing of the applicator.

SUMMARY OF THE DISCLOSED TECHNOLOGY

Disclosed herein is a cosmetic applicator including a bottle and a section. The bottle includes a reservoir, a first roller ball, a first fastener, and a first recess including a second fastener. Multiple identical bottles which are stackable, one into a next bottle, are also used in embodiments of the disclosed technology. The first roller ball is in fluid communication with the reservoir. The section includes a receptacle, a second roller ball, a third fastener, and a second recess comprising a fourth fastener. The second roller ball is in fluid communication with the receptacle. The first recess removably receives the second roller ball and the second fastener removably connects to the third fastener to position the bottle and the section in a stacked configuration.

In embodiments, the section includes a plurality of sections each including the receptacle, the second roller ball, the third fastener and the second recess comprising the fourth fastener. Each of the second recesses removably receives the second roller ball of a separate section of the plurality of sections. Each of the third fasteners removably connects to the second fastener of the bottle and the fourth fastener of a separate section of the plurality of sections to removably connect the bottle to a section of the plurality of sections and to removably connect the plurality of sections to each other to enable attachment of the bottle and the plurality of sections to one another in a stacked configuration.

In some embodiments, the bottle includes a cylindrical container including a first end, a second end, a wall extending between the first end and the second end and defining the reservoir and a first roller ball housing attached to the first end of the cylindrical container. In one embodiment, the first roller ball housing includes a diameter narrower than a diameter of the cylindrical container.

In certain embodiments, the plurality of sections includes a cylindrical vessel including a first end, a second end, a wall extending between the first end and the second end and defining the receptacle, and a second roller ball housing attached to the first end of the cylindrical vessel. In one embodiment, the second roller ball housing includes a diameter less than a diameter of the cylindrical vessel.

In other embodiments, the first fastener of the bottle extends outwardly from the first end of the bottle and includes a first opening defining a perimeter edge. The first opening removably receives the first roller ball housing therein. In one embodiment, the first fastener includes a diameter less than a diameter of the reservoir of the bottle.

In embodiments, the third fastener of the plurality of sections extends outwardly from the first end of the plurality of sections and includes a second opening defining a perimeter edge. The second opening removably receives the second roller ball housing therein. In one embodiment, the third fastener includes a diameter less than a diameter of the reservoir of a section of the plurality of sections.

In some embodiments, the first roller ball housing includes a tubular body including a first end, a second end, a wall including an interior surface and an exterior surface, and a shoulder. The wall extends between the first end and the second end. The shoulder extends annularly about the exterior surface of the wall. The first roller ball extends outwardly from the first end and is rotatably disposed in the first end.

In certain embodiments, the shoulder extends perpendicularly outwardly relative to the exterior surface of the wall, the tubular body friction fits within the first fastener, and when the first roller ball housing is attached to the bottle, the shoulder abuts the perimeter edge of the first opening of the first fastener to contain the first roller ball housing therein.

In other embodiments, the tubular body further includes an interior shoulder disposed on the interior surface of the wall. The interior shoulder maintains the first roller ball in position within the tubular body. The first roller ball rests on the interior shoulder to be prevented from falling through the tubular body. In one embodiment, the distance of the shoulder from the first end is less than a diameter of the first roller ball.

In embodiments, the second roller ball housing includes a second tubular body including a first end, a second end, a wall including an interior surface and an exterior surface, and a shoulder. The wall extends between the first end and the second end. The shoulder extends annularly about the exterior surface of the wall. The second roller ball extends from the first end and is rotatably disposed in the first end.

In some embodiments, the shoulder extends perpendicularly outwardly relative to the exterior surface of the wall, the second tubular body friction fits within the third fastener, and when the second roller ball housing is attached to the bottle, the shoulder abuts the perimeter edge of the second opening of the third fastener to contain the second roller ball housing therein.

In certain embodiments, the second tubular body further includes an interior shoulder disposed on the interior surface of the wall of the second tubular body. The interior shoulder maintains the second roller ball in position within the second tubular body. The second roller ball rests on the interior shoulder to be prevented from falling through the second tubular body. In one embodiment, the distance of the shoulder from the first end of the second tubular body is less than a diameter of the second roller ball.

In other embodiments, the distance of the first end of the container to the first end of the first roller ball housing is equal to or less than the depth of the recess of each of the plurality of sections.

In embodiments, the second fastener of the bottle threadably engages the third fastener of a section of the plurality of sections and the third fastener threadably engages the fourth fastener of a section of the plurality of sections.

In some embodiments, the distance of the first end of the vessel to the first end of the second roller ball housing is equal to or less than the depth of the recess of each of the plurality of sections.

In certain embodiments, the recess of each of the plurality of sections includes a diameter equal to or less than the diameter of the first roller ball housing and the second roller ball housing.

In other embodiments, the cosmetic applicator includes a cap removably attachable to the first fastener to cover the first roller ball housing. The cap can be a fastener and/or one the afore-described fasteners of this disclosure.

In embodiments, the first fastener and the third fastener each comprise threaded members having threads disposed on an exterior surface thereof and the second fastener, fourth fastener, and in some embodiments, the cap, each comprise threads disposed on an interior wall of the first recess and second recess, respectively.

For purposes of this disclosure, the following definitions are used. "Coaxial" is defined as "having a common axis." "Concentric" is defined as "of or denoting circles, arcs, or other shapes, or devices which share the same center." "Axial" is defined as "of, forming, or relating to an axis." "Radial" is defined as of or arranged like the radii of a circle or diverging from a common center." "Bottle" is defined as a structure, such as a container, that contains or can contain a fluid or material." "Section" is defined as "a discrete segment or portion of a larger whole or one of several component parts that may be assembled or reassembled." "Reservoir" is defined as "a structure defining a volume that receives and contains a liquid or material." "Receptacle" is defined as "a structure defining a volume that receives and contains a liquid or material." "Container" is defined as "a receptacle that contains or can contain a fluid or material." "Vessel" is defined as "a receptacle that contains or can contain a fluid or material." "Thread" is defined as "a projecting helical rib by which parts can be screwed together."

Any device or step to a method described in this disclosure can comprise or consist of that which it is a part of, or the parts which make up the device or step. The term "and/or" is inclusive of the items which it joins linguistically and each item by itself. "Substantially" is defined as at least 95% of the term being described and/or "within a tolerance level known in the art and/or within 5% thereof. Any device or aspect of a device or method described herein can be read as "comprising" or "consisting" thereof.

DETAILED DESCRIPTION OF EMBODIMENTS OF THE DISCLOSED TECHNOLOGY

The present disclosed technology provides a cosmetic applicator comprising a cosmetic applicator bottle and one or more sections that are removably attachable to the bottle and each other in a stacked configuration.

Figure 1:
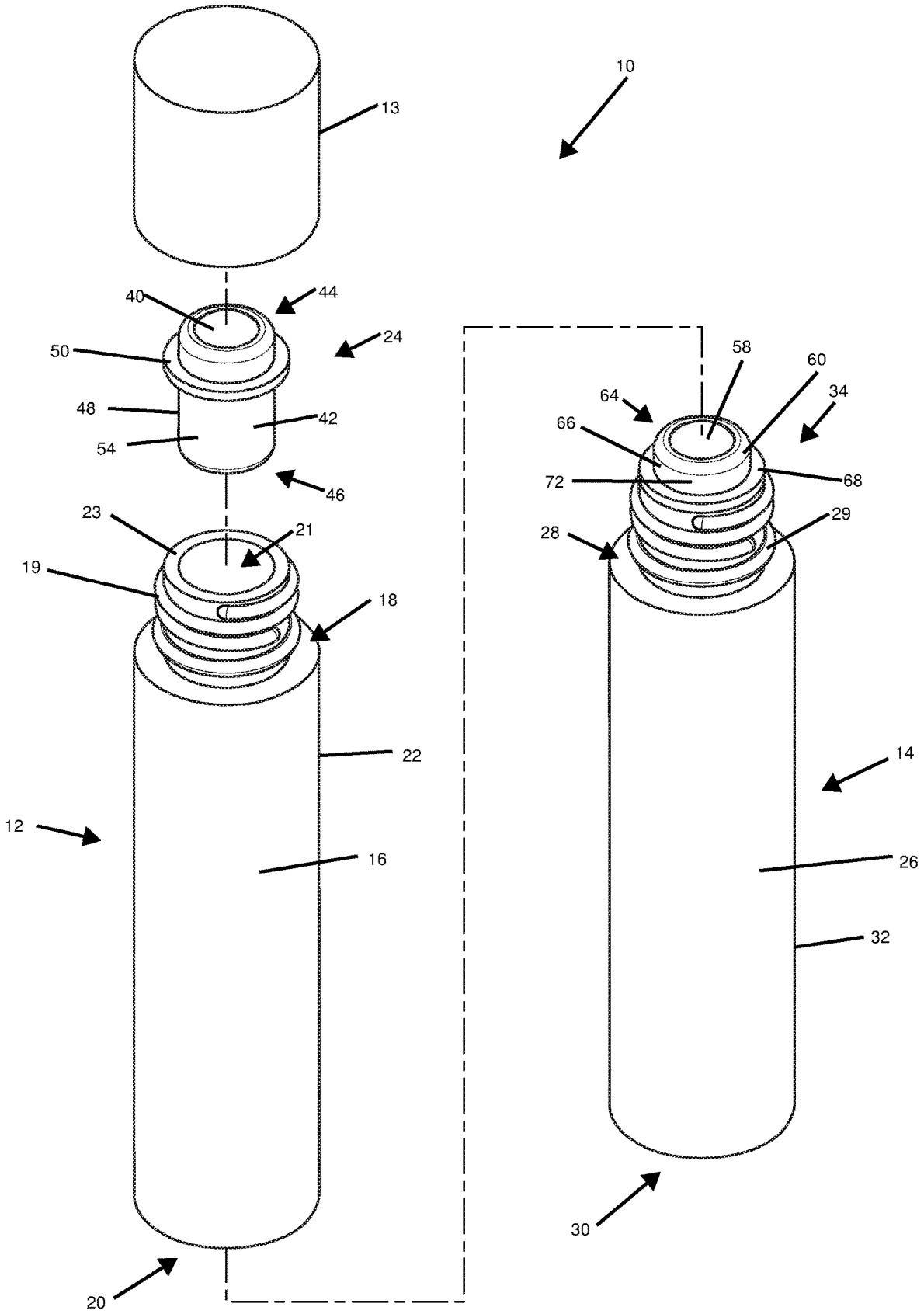
FIG. 1 shows an exploded top perspective view of the cosmetic applicator, illustrating how the bottle and plurality of sections attach to each other to form a stacked configuration according to one embodiment of the present disclosed technology.
Figure 2:
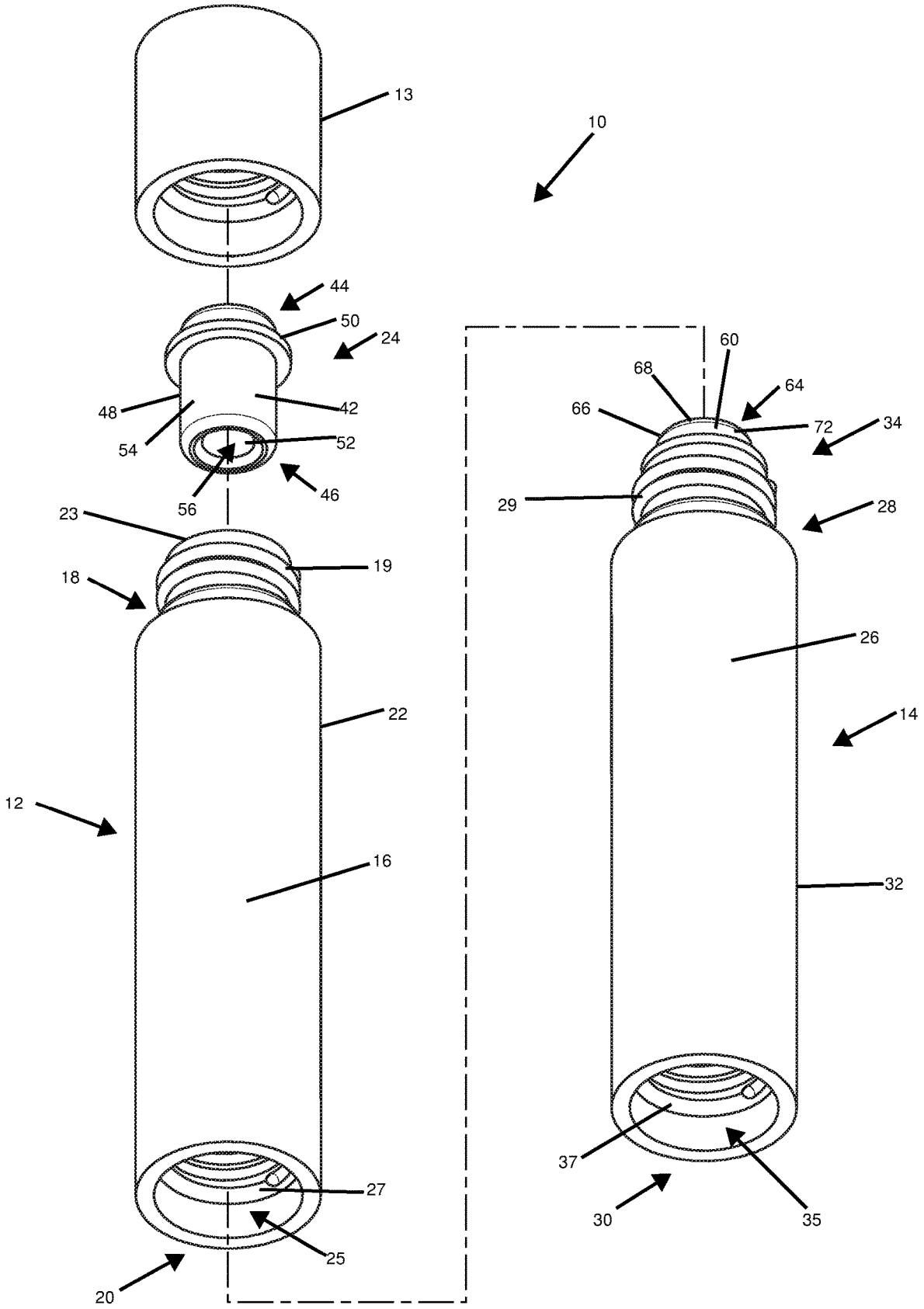
FIG. 2 shows an exploded bottom perspective view of the cosmetic applicator, illustrating how the bottle and plurality of sections attach to each other to form a stacked configuration according to one embodiment of the present disclosed technology.
Figure 3:
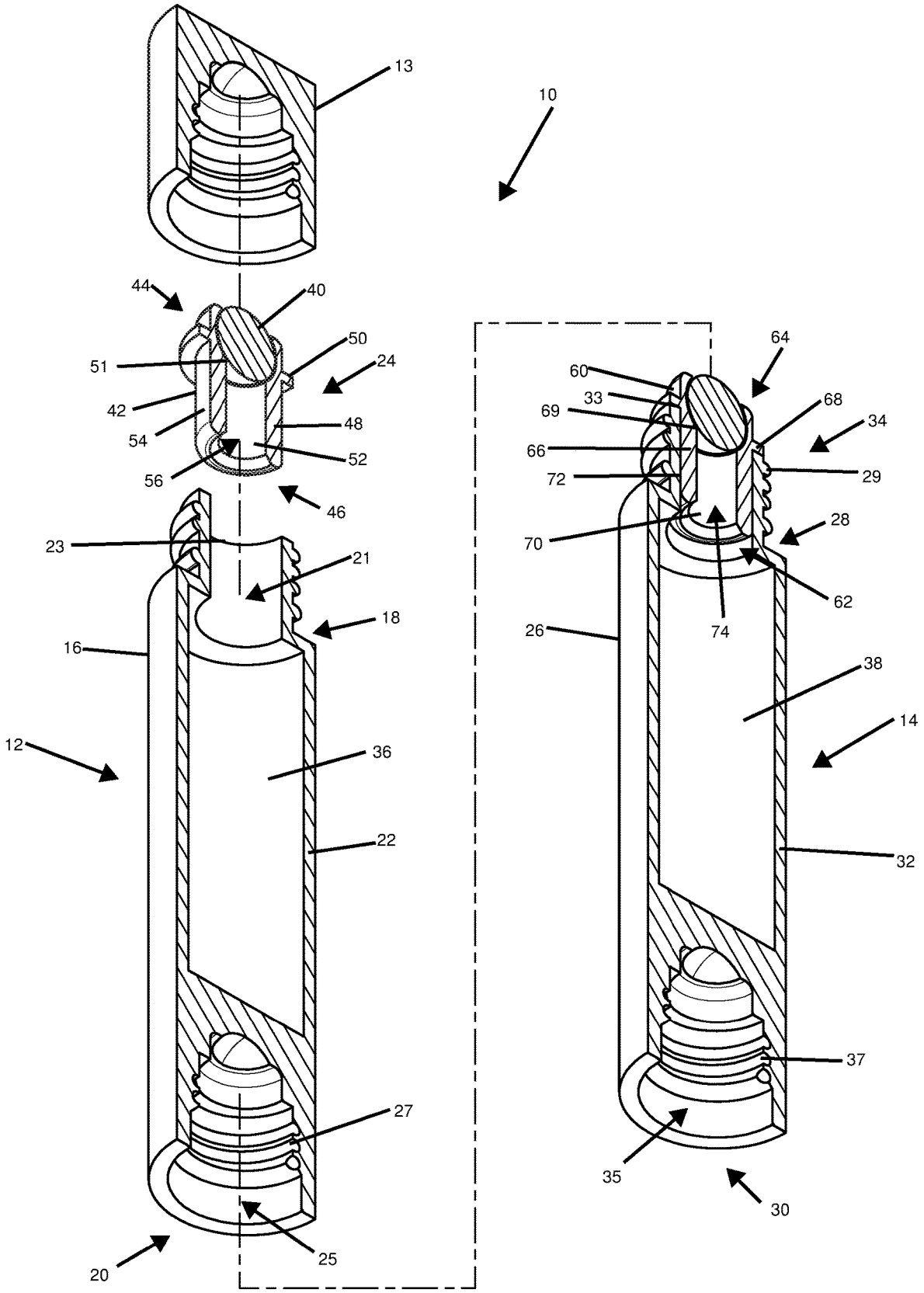
FIG. 3 shows an exploded cross-sectional top perspective view of the cosmetic applicator, illustrating how the bottle and the plurality of sections attach to one another to make a stacked configuration according to one embodiment of the present disclosed technology.
Figure 4A:
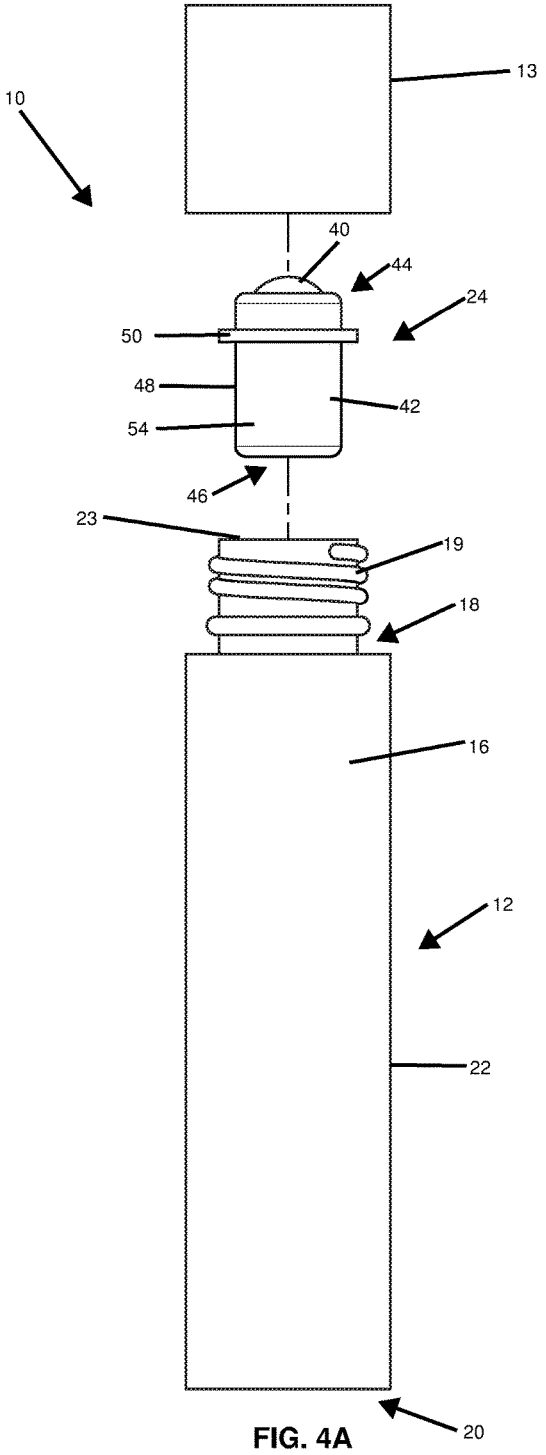
FIG. 4A shows a partial exploded elevation view of the cosmetic applicator according to one embodiment of the present disclosed technology.
Figure 4B:
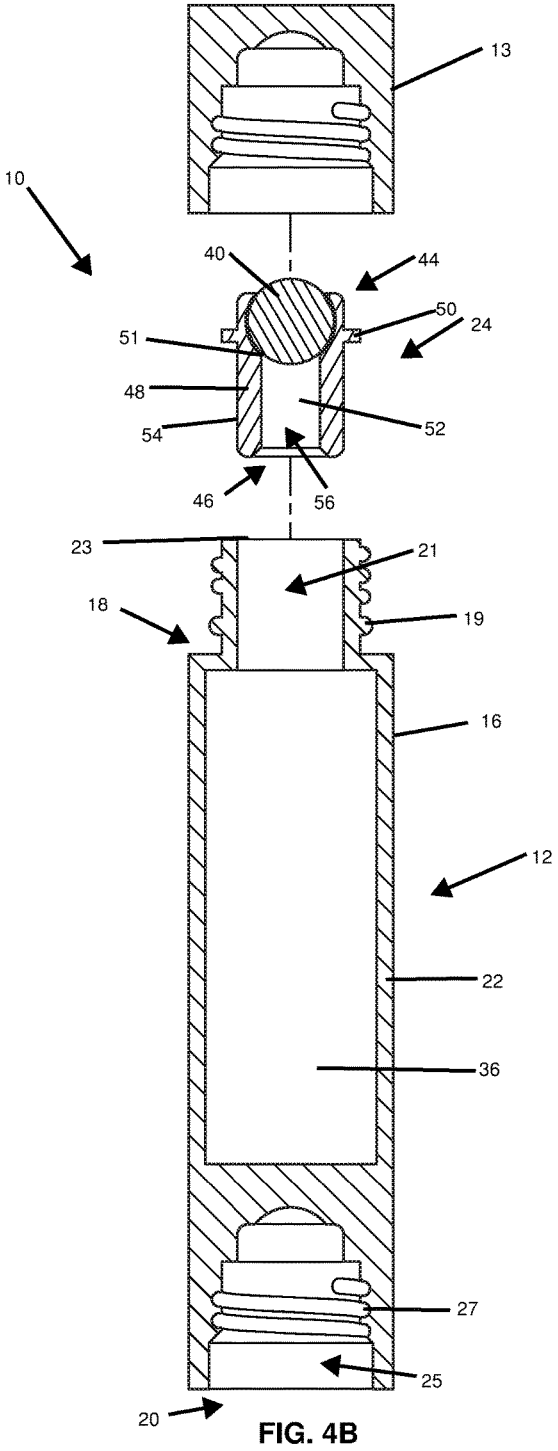
FIG. 4B shows a partial cross-sectional elevation view of the cosmetic applicator according to one embodiment of the present disclosed technology.

Referring now to FIGS. 1-4B, simultaneously, FIG. 1 shows an exploded top perspective view of the cosmetic applicator. FIG. 2 shows an exploded bottom perspective view of the cosmetic applicator. FIG. 3 shows an exploded cross-sectional top perspective view of the cosmetic applicator. FIG. 4A shows a partial exploded elevation view of the cosmetic applicator according to one embodiment of the present disclosed technology. FIG. 4B shows a partial cross-sectional elevation view of the cosmetic applicator according to one embodiment of the present disclosed technology. The present disclosed technology provides a cosmetic applicator 10 comprising a bottle 12 and a plurality of sections 14 that detachably connect to each other in a stacked configuration.

In embodiments, the bottle 12 comprises a tubular container 16 including a first end 18, a second end 20, a wall 22 extending between the first end 18 and the second end 20, and a first roller ball housing 24. The first end 18 comprises a first fastener 19. The first fastener 19 extends outwardly from the first end 18 and includes a first opening 21 defining a perimeter edge 23. The first opening 21 is configured to removably receive the first roller ball housing 24 therein. The second end 20 comprises a first recess 25 including a second fastener 27. The wall 22 of the bottle 12 defines a reservoir 36 within the bottle 12 that is configured to receive and maintain a fluid or a material to be applied. In some embodiments, the first fastener 19 comprises a threaded member including an exterior surface having threads. In one embodiment, the first fastener 19 includes a diameter less than a diameter of the reservoir 36. In certain embodiments, the cosmetic applicator 10 comprises a cap 13 that removably attaches to the first fastener 19 and the third fastener 29 of the plurality of sections 14 via a threaded engagement.

In embodiments, each of the plurality of sections 14 comprises a tubular vessel 26 including a first end 28, a second end 30, a wall 32 extending between the first end 28 and the second end 30, and a second roller ball 34 housing. The first end 28 comprises a third fastener 29. The third fastener 29 extends outwardly from the first end 28 and includes a second opening defining a perimeter edge. The second opening is configured to removably receive the second roller ball housing 34 therein. The second end 30 comprises a second recess 35 including a fourth fastener 37. The wall 32 of the plurality of sections 14 defines a receptacle 38 within the plurality of sections 14 that is configured to receive and maintain a fluid or material to be applied. In one embodiment, the third fastener 29 includes a diameter less than a diameter of the receptacle 38 of the plurality of sections 14.

In embodiments, the first roller ball housing 24 is detachably connected to the first end 18 of the bottle 12. The first roller ball housing 24 comprises a first roller ball 40 and a first tubular body 42. The first roller ball 40 is in fluid communication with the reservoir 36 of the bottle 12 and includes a diameter less than a diameter of the first tubular body 42. The first tubular body 42 includes a diameter less than a diameter of the tubular container 16. In one embodiment, the first tubular body 42 friction fits within the first opening 21 of the first fastener 19.

In embodiments, the first tubular body 42 comprises a first end 44, a second end 46, a wall 48, an exterior shoulder 50, and an interior shoulder 51. In some embodiments, the distance of the first end 18 of the tubular container 16 to the first end 44 of the first tubular body 42 of the first roller ball housing 24 is equal to or less than a depth of the second recess 35 of each of the plurality of sections 14. The wall 48 includes an interior surface 52 and an exterior surface 54. The wall 48 extends between the first end 44 and the second end 46 and defines a longitudinal bore 56 extending from the first end 44 to the second end 46. The exterior shoulder 50 extends annularly about the exterior surface 54 of the wall 48 such that the exterior shoulder 50 is concentric with the first tubular body 42. In some embodiments, the shoulder 50 extends orthogonally outwardly relative to the exterior surface 54 of the wall 48. In other embodiments, the exterior shoulder 50 extends radially outwardly from the exterior surface 54 of the wall 48. When the first roller ball housing 24 is attached to the bottle 12, the exterior shoulder 50 abuts the perimeter edge 23 of the first opening 21 of the first fastener 19 to contain the first roller ball housing 24 therein. The first roller ball 40 is rotatably disposed within the longitudinal bore 56 and extends outwardly from the first end 44.

The interior shoulder 51 is disposed on the interior surface 52 of the wall 48 and extends inwardly toward a center of the longitudinal bore 56. The interior shoulder 51 maintains the first roller ball 40 in position within the longitudinal bore 56 of the first tubular body 42 such that the first roller ball 40 extends outwardly from the first end 44. The first roller ball 40 rests on the interior shoulder 51, which prevents the first roller ball 40 from falling through the first tubular body 40. The distance of the interior shoulder 51 from the first end 44 is less than a diameter of the first roller ball 40 such that the first roller ball 40 protrudes outwardly from the first end 44.

In embodiments, the second roller ball housing 34 is detachably connected to the first end 28 of the plurality of sections 14. The second roller ball housing 34 comprises a second roller ball 58 and a second tubular body 60. The second roller ball 58 is in fluid communication with the receptacle 38 of the plurality of sections 14 and includes a diameter narrower than a diameter of the second tubular body 60. The second tubular body 60 includes a diameter less than a diameter of the tubular vessel 26. In one embodiment, the second tubular body 60 friction fits within the second opening of the third fastener 29.

In embodiments, the second tubular body 60 comprises a first end 64, a second end 62, a wall 66, an exterior shoulder 68, and an interior shoulder 69. In some embodiments, the distance of the first end 28 of the tubular vessel 26 to the first end 64 of the second tubular body 60 of the second roller ball housing 34 is equal to or less than a depth of the second recess 35 of each of the plurality of sections 14 and the first recess 25 of the bottle 12. In other embodiments, the second recess 35 of each of the plurality of sections 14 includes a diameter equal to or less than a diameter of the first roller ball housing 24 and the second roller ball housing 34. The wall 66 includes an interior surface 70 and an exterior surface 72. The wall 66 extends between the first end 64 and the second end 62 and defines a longitudinal bore 74 extending from the first end 64 to the second end 62. The exterior shoulder 68 extends annularly about the exterior surface 72 of the wall 66 such that the exterior shoulder 68 is concentric with the second tubular body 60. In some embodiments, the exterior shoulder 68 extends orthogonally outwardly relative to the exterior surface 72 of the wall 66. In other embodiments, the exterior shoulder 68 extends radially outwardly from the exterior surface 72 of the wall 66. When second roller ball housing 34 is attached to the plurality of sections 14, the exterior shoulder 68 abuts the perimeter edge 33 of the second opening 30 of the third fastener 29 to contain the second roller ball housing 34 therein. The second roller ball 58 is rotatably disposed within the longitudinal bore 74 and extends outwardly from the first end 64.

The interior shoulder 69 is disposed on the interior surface 70 of the wall 66 and extends inwardly toward a center of the longitudinal bore 74. The interior shoulder 69 maintains the second roller ball 58 in position within the longitudinal bore 74 of the second tubular body 60 such that the second roller ball 58 extends outwardly from the first end 64. The second roller ball 58 rests on the interior shoulder 69, which prevents the second roller ball 58 from falling through the second tubular body 60. The distance of the interior shoulder 69 from the first end 64 is less than a diameter of the second roller ball 58 such that the second roller ball 58 protrudes outwardly from the first end 64.

Figure 5A:
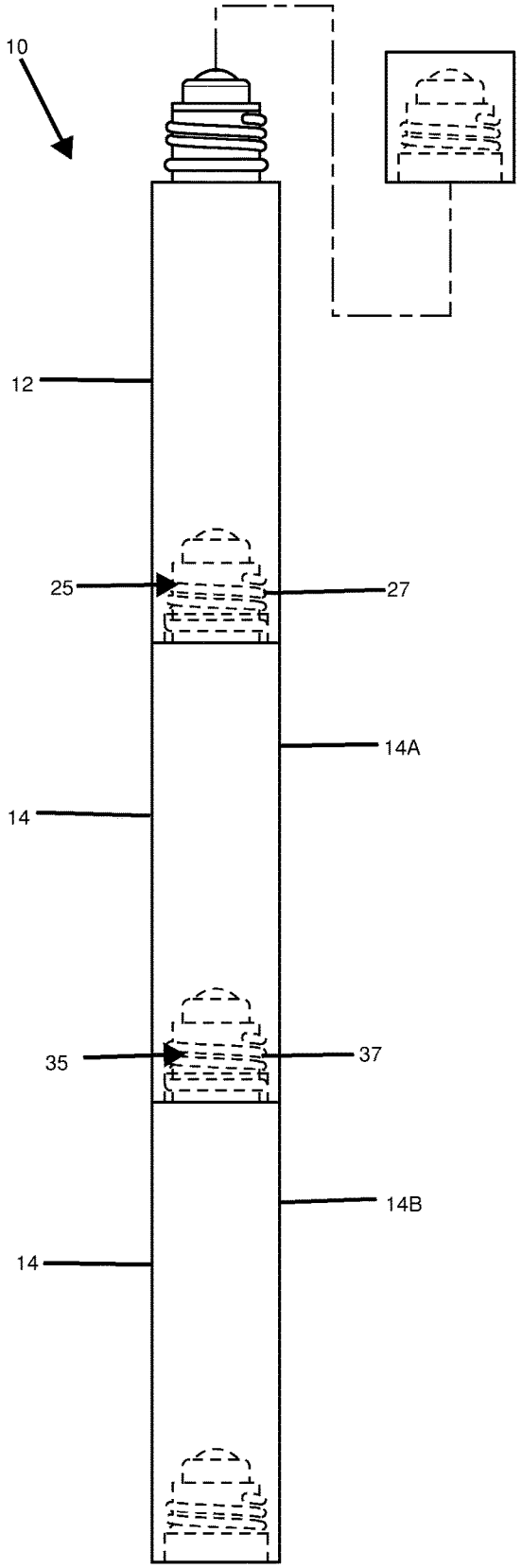
FIG. 5A shows a phantom elevation view of the cosmetic applicator in a stacked configuration according to one embodiment of the present disclosed technology.
Figure 5B:
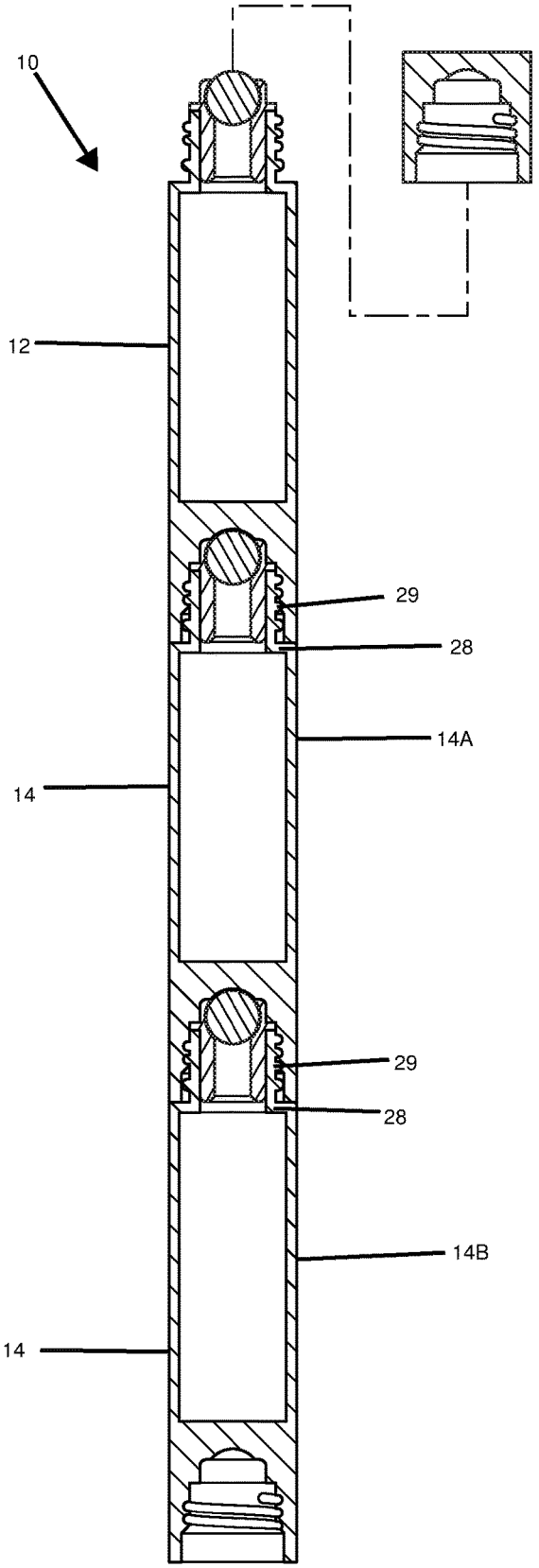
FIG. 5B shows a cross-sectional elevation view of the cosmetic applicator in a stacked configuration according to one embodiment of the present disclosed technology.
Figure 6:
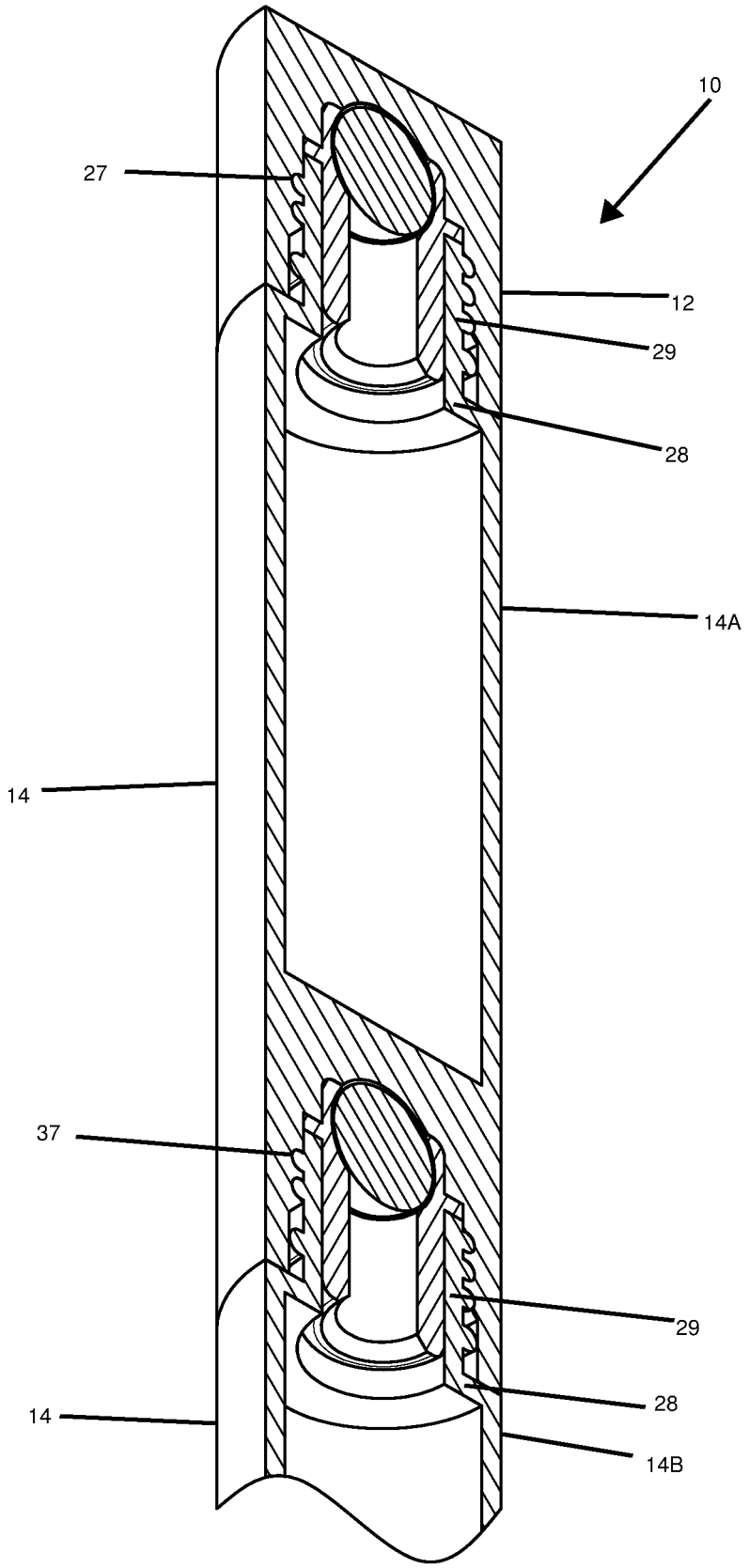
FIG. 6 shows a close-up, cross-sectional perspective view of the cosmetic applicator in a stacked configuration according to one embodiment of the present disclosed technology.

Referring now to FIGS. 5A-6, simultaneously, FIG. 5A shows a phantom elevation view of the cosmetic applicator in a stacked configuration according to one embodiment of the present disclosed technology. FIG. 5B shows a cross-sectional elevation view of the cosmetic applicator in a stacked configuration according to one embodiment of the present disclosed technology. FIG. 6 shows a close-up, cross-sectional perspective view of the cosmetic applicator in a stacked configuration according to one embodiment of the present disclosed technology.

In embodiments, the first recess 25 of the bottle 12 is sized to receive the first end 28 of a first section 14A of the plurality of sections 14. The second fastener 27 of the first recess 25 fastens to the third fastener 29 of a first section 14A of the plurality of sections 14 to fasten the first section 14A of the plurality of sections 14 and the bottle 12 in a stacked configuration. In some embodiments, the second fastener 27 threadably engages the third fastener 29. In one embodiment, the second fastener 27 comprises threads disposed on an interior wall of the first recess 25. In one embodiment, the third fastener 29 comprises a threaded member including an exterior surface having threads disposed thereon. When in a stacked configuration, the bottle 12 and the first section 14A of the plurality of sections 14 form a coaxial and coplanar cosmetic applicator 10, in which the bottle 12 and the first section 14A are aligned along a common longitudinal plane.

In embodiments, the second recess 35 of the plurality of sections 14 is sized to receive the first end 28 of a separate second section 14B of the plurality of sections 14. The fourth fastener 37 of the second recess 35 of the first section 14A of the plurality of sections 14 fastens to the third fastener 29 of a separate second section 14B of the plurality of sections 14 to fasten the first section 14A with the second section 14B. In this way, each of the plurality of sections 14 of the cosmetic applicator 10 can be detachably and interchangeably connected in a stacked configuration. In some embodiments, the third fastener 29 threadably engages the fourth fastener 37. In one embodiment, the fourth fastener 37 comprises threads disposed on an interior wall of the second recess 35. When in a stacked configuration, the bottle 12, the first section 14A, and the second section 14B form a coaxial and coplanar cosmetic applicator 10, in which the bottle 12, the first section 14A, and the second section 14B are aligned along a common longitudinal plane.

The present technology can be carried out with one or more of the embodiments described. The drawings show embodiments with the understanding that the present description is to be considered an exemplification of the principles and is not intended to be exhaustive or to limit the disclosure to the details of construction. The arrangements of the components are set forth in the following description or illustrated in the drawings.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A cosmetic applicator, comprising:

a bottle including a reservoir, a first roller ball, a first fastener, and a first recess including a second fastener, the first roller ball in fluid communication with the reservoir; and a section including a receptacle, a second roller ball, a third fastener, and a second recess comprising a fourth fastener, the second roller ball in fluid communication with the receptacle;

wherein:

the first recess removably receives the second roller ball; and the second fastener removably connects to the third fastener to position the bottle and the section in a stacked configuration.

2. The cosmetic applicator of claim 1, wherein the section comprises a plurality of sections, each of the plurality of sections including the receptacle, the second roller ball, the third fastener and the second recess comprising the fourth fastener, wherein:

each of the second recesses removably receives the second roller ball of a separate section of the plurality of sections; and each of the third fasteners removably connects to the second fastener of the bottle and the fourth fastener of a separate section of the plurality of sections to removably connect the bottle to a section of the plurality of sections and to removably connect the plurality of sections to each other to enable attachment of the bottle and the plurality of sections to one another in a stacked configuration.

3. The cosmetic applicator of claim 2, wherein the bottle further comprises:

a tubular container including a first end, a second end, a wall extending between the first end and the second end and defining the reservoir; and a first roller ball housing detachably connected to the first end of the tubular container, the first roller ball housing having a diameter narrower than a diameter of the tubular container.

4. The cosmetic applicator of claim 3, wherein each of the plurality of sections comprises:

a tubular vessel including a first end, a second end, a wall extending between the first end and the second end and defining the receptacle; and a second roller ball housing detachably connected to the first end of the tubular vessel, the second roller ball housing having a diameter less than a diameter of the tubular vessel.

5. The cosmetic applicator of claim 4, wherein the first fastener of the bottle extends outwardly from the first end of the bottle and includes a first opening defining a perimeter edge, the first opening to receive the first roller ball housing therein.

6. The cosmetic applicator of claim 5, wherein the first fastener includes a diameter less than a diameter of the reservoir of bottle.

7. The cosmetic applicator of claim 5, wherein the third fastener of the plurality of sections extends outwardly from the first end of the plurality of sections and includes a second opening defining a perimeter edge, the second opening to receive the second roller ball housing therein.

8. The cosmetic applicator of claim 7, wherein the third fastener includes a diameter less than a diameter of the receptacle of a section of the plurality of sections.

9. The cosmetic applicator of claim 7, wherein:

the first roller ball housing comprises a tubular body including a first end, a second end, a wall including an interior surface and an exterior surface, and a shoulder;

the wall extends between the first end and the second end;

the shoulder extends annularly about the exterior surface of the wall; and the first roller ball extends outwardly from the first end and is rotatably disposed in the first end.

10. The cosmetic applicator of claim 9, wherein:

the shoulder extends perpendicularly outwardly relative to the exterior surface of the wall;

the tubular body friction fits within the first fastener; and when the first roller ball housing is attached to the bottle, the shoulder abuts the perimeter edge of the first opening of the first fastener to contain the first roller ball housing therein.

11. The cosmetic applicator of claim 9, wherein:

the tubular body further comprises an interior shoulder disposed on the interior surface of the wall, the interior shoulder configured to maintain the first roller ball in position within the tubular body;

the first roller ball rests on the interior shoulder to be prevented from falling through the tubular body;

the distance of the shoulder from the first end is less than a diameter of the first roller ball.

12. The cosmetic applicator of claim 9, wherein:

the second roller ball housing comprises a second tubular body including a first end, a second end, a wall including an interior surface and an exterior surface, and a shoulder;

the wall extends between the first end and the second end;

the shoulder extends annularly about the exterior surface of the wall; and the second roller ball extends from the first end and is rotatably disposed in the first end.

13. The cosmetic applicator of claim 12, wherein:

the shoulder extends perpendicularly outwardly relative to the exterior surface of the wall;

the second tubular body friction fits within the third fastener; and when the second roller ball housing is attached to the plurality of sections, the shoulder abuts the perimeter edge of the second opening of the third fastener to contain the second roller ball housing therein.

14. The cosmetic applicator of claim 13, wherein:

the second tubular body further comprises an interior shoulder disposed on the interior surface of the wall of the second tubular body, the interior shoulder configured to maintain the second roller ball in position within the second tubular body;

the second roller ball rests on the interior shoulder to be prevented from falling through the second tubular body;

the distance of the shoulder from the first end of the second tubular body is less than a diameter of the second roller ball.

15. The cosmetic applicator of claim 12, wherein the distance of the first end of the tubular container to the first end of the first roller ball housing is equal to or less than a depth of the second recess of each of the plurality of sections.

16. The cosmetic applicator of claim 12, wherein:

the second fastener of the bottle threadably engages the third fastener of a section of the plurality of sections; and the third fastener threadably engages the fourth fastener of a section of the plurality of sections.

17. The cosmetic applicator of claim 15, wherein the distance of the first end of the tubular vessel to the first end of the second roller ball housing is equal to or less than a depth of the second recess of each of the plurality of sections.

18. The cosmetic applicator of claim 16, wherein the second recess of each of the plurality of sections includes a diameter equal to or greater than a diameter of the first roller ball housing and the second roller ball housing.

19. The cosmetic applicator of claim 7, further comprising a cap removably attachable to the first fastener or the third fastener covering a respective roller ball housing.

20. The cosmetic applicator of claim 7, wherein:

the first fastener and the third fastener each comprise threaded members having threads disposed on an exterior surface thereof; and the second fastener and fourth fastener each comprises threads disposed on an interior wall of the first recess and second recess, respectively.

* * * * *